US008235025B2

(12) United States Patent
Nishimura et al.

(10) Patent No.: US 8,235,025 B2
(45) Date of Patent: Aug. 7, 2012

(54) THROTTLE APPARATUS

(75) Inventors: Shin Nishimura, Saitama (JP); Seizo Tamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 374 days.

(21) Appl. No.: 12/693,843

(22) Filed: Jan. 26, 2010

(65) Prior Publication Data

US 2010/0212627 A1 Aug. 26, 2010

(30) Foreign Application Priority Data

Feb. 25, 2009 (JP) ..... 2009-042808

(51) Int. Cl.
*F02D 9/10* (2006.01)

(52) U.S. Cl. ..... 123/337; 251/305

(58) Field of Classification Search ..... 123/337, 123/361, 399; 251/305, 339
See application file for complete search history.

(56) References Cited

U.S. PATENT DOCUMENTS

| | | | | |
|---|---|---|---|---|
| 4,860,706 | A * | 8/1989 | Suzuki et al. | 123/337 |
| 6,912,994 | B2 * | 7/2005 | Ozeki et al. | 123/399 |
| 7,290,526 | B2 * | 11/2007 | Maruo et al. | 123/339.14 |
| 7,588,014 | B2 * | 9/2009 | Tsugami et al. | 123/399 |
| 7,716,828 | B2 | 5/2010 | Miyauchi et al. | |
| 7,770,557 | B2 * | 8/2010 | Ikeda et al. | 123/337 |
| 2004/0129253 | A1 * | 7/2004 | Ozeki et al. | 123/399 |
| 2008/0029060 | A1 * | 2/2008 | Ikeda et al. | 123/337 |

FOREIGN PATENT DOCUMENTS

| | | | |
|---|---|---|---|
| DE | 112005001229 | T5 | 4/2007 |
| EP | 1413723 | A2 | 4/2004 |
| JP | 3-50347 | A | 4/1991 |
| JP | 10/61508 | A | 3/1998 |
| JP | 2002-309968 | A | 10/2002 |
| JP | 2002-357131 | A | 12/2002 |
| JP | 2004-144039 | A | 5/2004 |
| JP | 2007-40216 | A | 2/2007 |

* cited by examiner

*Primary Examiner* — Erick Solis
(74) *Attorney, Agent, or Firm* — Birch, Stewart, Kolasch & Birch, LLP

(57) ABSTRACT

A ventilation path is provided for communicating an accommodation chamber wherein a transmission mechanism for an electric motor is accommodated and an external space. A covering space is provided for covering an outer end opening of the ventilation path is opened to suppress formation of a water film at the outer end opening. A throttle apparatus includes a housing with covering walls defining covering spaces having open ports which are open to an external space. Lower end openings of ventilation paths are provided for communicating the external space and the accommodation chamber with each other are open to the covering spaces. The opening ports are set to such a size that adhering water flowing down along the lower outer face is cut into pieces between the covering walls and a housing body across the open ports.

20 Claims, 6 Drawing Sheets

THROTTLE APPARATUS

CROSS-REFERENCE TO RELATED APPLICATIONS

The present application claims priority under 35 USC 119 to Japanese Patent Application No. 2009-042808 filed on Feb. 25, 2009 the entire contents of which are hereby incorporated by reference.

BACKGROUND OF THE INVENTION

1. Field of the Invention

This invention relates to a throttle apparatus which includes an actuator for driving a throttle valve which controls the amount of air. More particularly, to a throttle apparatus which includes a housing in which a ventilation path is provided for being in communication with an accommodation chamber in which a transmission mechanism for transmitting a driving force of the actuator to the throttle valve is accommodated in an external space with each other. The throttle apparatus is provided, for example, in an internal combustion engine.

2. Description of Background Art

An internal combustion engine is known wherein a throttle apparatus which includes a throttle valve includes a driving apparatus which in turn includes an actuator (for example, an electric motor) for driving the throttle valve and a transmission mechanism for transmitting a driving force of the actuator to the throttle valve and a housing which defines an accommodation chamber in which the transmission mechanism is accommodated and the housing has a ventilation path provided therein for being in communication with the accommodation chamber and an external space in which external air which surrounds the housing exists. See, for example, Japanese Patent Laid-Open No. 2007-40216 and Japanese Patent Laid-Open No. 2004-144039.

Where an internal combustion engine which includes a throttle apparatus is incorporated, for example, in a vehicle, the throttle apparatus is surrounded, including a housing thereof, by an external space in which water such as rainwater exists. Therefore, in order to suppress water from intruding into an accommodation chamber through a ventilation path when the housing is splashed with water, while a required ventilation function is assured, the opening area of the ventilation path on the outer face of the housing is reduced or a draining projection is provided on the housing or else the ventilation path is formed as a labyrinth. By the countermeasure, intrusion of water into the accommodation chamber described above is suppressed.

In addition, one of the cases wherein water intrudes into the accommodation chamber through the ventilation path is a case wherein, when the pressure in the accommodation chamber is caused to drop by a temperature change or the like in a state wherein water drops flying to the housing which defines the accommodation chamber or adhering water adhering to the housing and flowing down along the outer face of the housing forms a water film at an outer end opening of the ventilation path (that is, at the opening of the ventilation path on the outer face of the housing) and closes up the outer end opening, the water which closes up the outer end opening is sometimes taken into the accommodation chamber.

With regard to the intrusion of water caused by formation of a water film at the outer end opening of the ventilation path as described above, where the outer end opening of the ventilation path is exposed to the external space, it is difficult to suppress the water film formation at the outer end opening.

Further, if the opening area of the outer end opening is reduced in order to suppress intrusion of water into the ventilation path, then a water film becomes likely to be formed at the outer end opening. On the other hand, if the opening area of the outer end opening is increased in order to suppress formation of a water film, then water becomes likely to intrude into the ventilation path from the outer end opening.

SUMMARY AND OBJECTS OF THE INVENTION

The present invention has been made in view of such a situation as described above, and it is an object of an embodiment of the present invention to provide, in a throttle apparatus which includes a housing in which a ventilation path is provided for communicating an accommodation chamber in which a transmission mechanism for transmitting driving force of an actuator to a throttle valve is accommodated and an external space with each other, a covering space in which an outer end opening of the ventilation path is opened to suppress the formation of a water film at the outer end opening thereby to achieve enhancement of the effect of the suppression of intrusion of water into the accommodation chamber through the ventilation path.

In addition, it is another object of an embodiment of the present invention to reduce the pressure variation in the accommodation chamber by means of the covering space to achieve enhancement of the effect of suppression of intrusion of water into the accommodation chamber through the ventilation path.

According to an embodiment of the present invention, a throttle apparatus includes a throttle body (10) for supporting a throttle valve (11) for controlling the flow rate of air to flow through an air path, a driving apparatus (12) including an actuator (13) for driving the throttle valve (11) and a transmission mechanism (14) for transmitting driving force of the actuator (13) to the throttle valve (11), and a housing (H) in which a ventilation path (50) for communicating an accommodation chamber (40) in which the transmission mechanism (14) is accommodated and an external space (S) with each other is provided. The embodiment of the present invention is configured such that the housing (H) has a housing body (H1) which has a body outer face (Ha) including an outer face portion to which water in the external space (S) can adhere as adhering water and in which the ventilation path (50) is provided, and a covering wall (60) for cooperating with the housing body (H1) to define a covering space (70) having an open port (70*a*) which is open to the external space (S), that an outer end opening (50*b*) of the ventilation path (50) is open to the covering space (70) at a lower outer face (Hb) of the body outer face (Ha) which faces vertically downwardly, that the covering wall (60) covers a covering region (75, 76), which includes the entire outer end opening (50*b*) and a peripheral face (Hb1, Hb2) of the lower outer face (Hb) around the outer end opening (50*b*), from vertically downwardly and connects to the housing body (H1) on the upstream side with respect to the outer end opening (50*b*) in the covering region (75, 76) in regard to a flow of the adhering water which flows down along the lower outer face (Hb), and that the open port (70*a*) is open toward a particular horizontal direction (A3) which is a horizontal direction and has an opening area greater than the opening area of the outer end opening (50*b*) within an opening range (R1*a*, R2*a*) of the outer end opening (50*b*) in a maximum width direction (A5, A6) in which the outer end opening (50*b*) has a maximum opening width (W1, W2) as viewed from the particular horizontal direction (A3).

According to an embodiment of the present invention, the throttle apparatus is configured such that the opening width (W5, W6) of the open port (70*a*) in a direction (A7, A8) orthogonal to the maximum width direction (A5, A6) as viewed from the particular horizontal direction (A3) is greater than the opening width (W3, W4) of the outer end opening (50*b*) in the particular horizontal direction (A3) within a predetermined range (R1, R2) which includes the opening range (R1*a*, R2*a*) and is greater than the opening range (R1*a*, R2*a*) in the maximum width direction (A5, A6).

According to an embodiment of the present invention, the open port (70*a*) is set to a size with which the adhering water flowing down along the lower outer face (Hb) toward the covering wall (60) is cut into pieces between the covering wall (60) and the housing body (H1) across the open port (70*a*).

According to an embodiment of the present invention, the throttle apparatus is configured such that a first ventilation path (51, 52) and a second ventilation path (51, 52) are provided separately from each other in the housing body (H1), that the ventilation path (50) is at least one of the first ventilation path (51) and the second ventilation path (52), that the first ventilation path (51) serves also as a water draining path for allowing water in the accommodation chamber (40) to flow out to the external space (S), and that the second ventilation path (52) is positioned vertically upwardly with respect to the first ventilation path (51) and has a minimum path area smaller than the minimum path area of the first ventilation path (51).

According to an embodiment of the present invention, the throttle apparatus is configured such that the ventilation path (50) is a first ventilation path (51) and a second ventilation path (52) provided separately from each other, and that the first ventilation path (51) serves also as a water draining path for allowing water in the accommodation chamber (40) to flow out to the external space (S).

According to an embodiment of the present invention, the throttle apparatus is configured such that the covering wall (60) is a first covering wall (61) and a second covering wall (62), that the covering space (70) is a first covering space (71) which is defined by the first covering wall (61) and to which the first ventilation path (51) is open and a second covering space (72) which is defined by the second covering wall (62) and to which the second ventilation path (52) is open, that the housing body (H1) has a first projection (81) positioned on the upstream with respect to the first covering space (71) in regard to the flow of the adhering water which flows down along the lower outer face (Hb) and a second projection (82) positioned on the upstream with respect to the first projection (81) and the second covering space (72), and that the first projection (81) projects vertically downwardly farther than the outer end opening (51*b*) of the first ventilation path (51) and the second projection (82) projects vertically downwardly farther than the outer end opening (52*b*) of the second ventilation path (52).

According to an embodiment of the present invention, the throttle apparatus is configured such that a recessed space (36*a*, 37*a*) which is open to the covering space (70) is provided in the covering wall (60).

According to an embodiment of the present invention, the throttle apparatus includes the outer end opening of the ventilation path which provides communication between the accommodation chamber in which the transmission mechanism is accommodated and the external space with each other. The outer end opening is open to the lower outer face of the outer face of the housing body and open to the covering space defined by being covered from vertically downwardly with the covering wall. In addition, the covering wall connects to the housing body on the upstream side with respect to the outer end opening in the covering region. Thus, adhering water flowing down along the lower outer face is prevented from flowing into the covering space from the upstream side in the covering space. Therefore, water drops flying to the housing body and adhering water adhering to and flowing down along the lower outer face of the housing body are suppressed from intruding into the ventilation path through the outer end opening.

Further, since the opening area of the open port of the covering space is greater than the opening area of the outer end opening of the ventilation path in the maximum width direction within the opening range which corresponds to the position of the outer end opening, also where the opening area of the outer end opening is small, the outer end opening is in communication with the external space through the open port of the covering space. Therefore, in comparison with an alternative case wherein the outer end opening is exposed to the external space, adhering water flowing down along the body outer face is suppressed from forming a water film at the open port. Accordingly, formation of a water film at the outer end opening is suppressed and the intrusion suppression effect against water intruding into the accommodation chamber through the ventilation path is improved.

According to an embodiment of the present invention, since the opening width of the open port is greater over the predetermined range wider than the opening range, the opening area of the open port becomes further greater than the opening area of the outer end opening. Thus, adhering water is suppressed from forming a water film at the open port and the intrusion suppression effect against water intruding into the accommodation chamber through the ventilation path is improved.

According to an embodiment of the present invention, since adhering water is cut into pieces between the covering wall and the housing body across the open port, it is suppressed from forming a water film which closes up the open port. Consequently, the intrusion suppression effect against water intruding into the accommodation chamber through the ventilation path is improved.

According to an embodiment of the present invention, since the first and second ventilation paths are provided in the housing, discharge of water from the first ventilation path which is positioned vertically downwardly with respect to the second ventilation path and serves also as a water draining path from the accommodation chamber is promoted by ventilation between the accommodation chamber and the external space by the second ventilation path and by the fact that the minimum path area of the first ventilation path is greater than the minimum path area of the second ventilation path.

In addition, in the housing, at least one of the first and second ventilation paths is open to the covering space. Thus, intrusion of water into the accommodation chamber through the first ventilation path or the second ventilation path which is open to the covering space is suppressed. Further, since the minimum path area of the second ventilation path is smaller than that of the first ventilation path, intrusion of water into the accommodation chamber through the second ventilation path is suppressed.

According to an embodiment of the present invention, since the first and second ventilation paths are provided in the housing, discharge of water from the first ventilation path which serves also as a water draining path from the accommodation chamber is promoted by ventilation between the accommodation chamber and the external space by the second ventilation path. In addition, since the first and second ventilation paths are open to the covering space, intrusion of water into the accommodation chamber through the ventilation paths is suppressed.

According to an embodiment of the present invention, the first and second projections carry out a draining action of adhering water. Thus, intrusion of water into the first and second ventilation paths is suppressed. Further, since the covering space is formed on the downstream side with respect to the projections, formation of a water film at the open ports of the covering spaces is further suppressed and the intrusion suppression effect against water is improved.

According to an embodiment of the present invention, the ventilation path is in communication with the space in the covering wall which is greater by an amount corresponding to the recessed space open to the covering space in comparison with that in an alternative case wherein only the covering space is provided. Thus, the pressure variation caused in the covering space through the ventilation path by a pressure variation of the accommodation chamber decreases. As a result, when the pressure in the accommodation chamber drops, the force for sucking water through the open port decreases. Consequently, the intrusion suppression effect against water intruding into the accommodation chamber through the ventilation path is improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5(*b*) is a sectional view taken along line Vb-Vb of FIG. 3;

FIG. 5(*c*) is a sectional view taken along line Vc-Vc of FIG. 3;

FIG. 6(*b*) is a sectional view taken along line VIb-VIb of FIG. 3; and

FIG. 6(*c*) is a sectional view taken along line VIc-VIc of FIG. 3.

DETAILED DESCRIPTION OF THE PREFERRED EMBODIMENTS

In the following, an embodiment of the present invention is described with reference to FIGS. 1 to 6.

Figure 1:
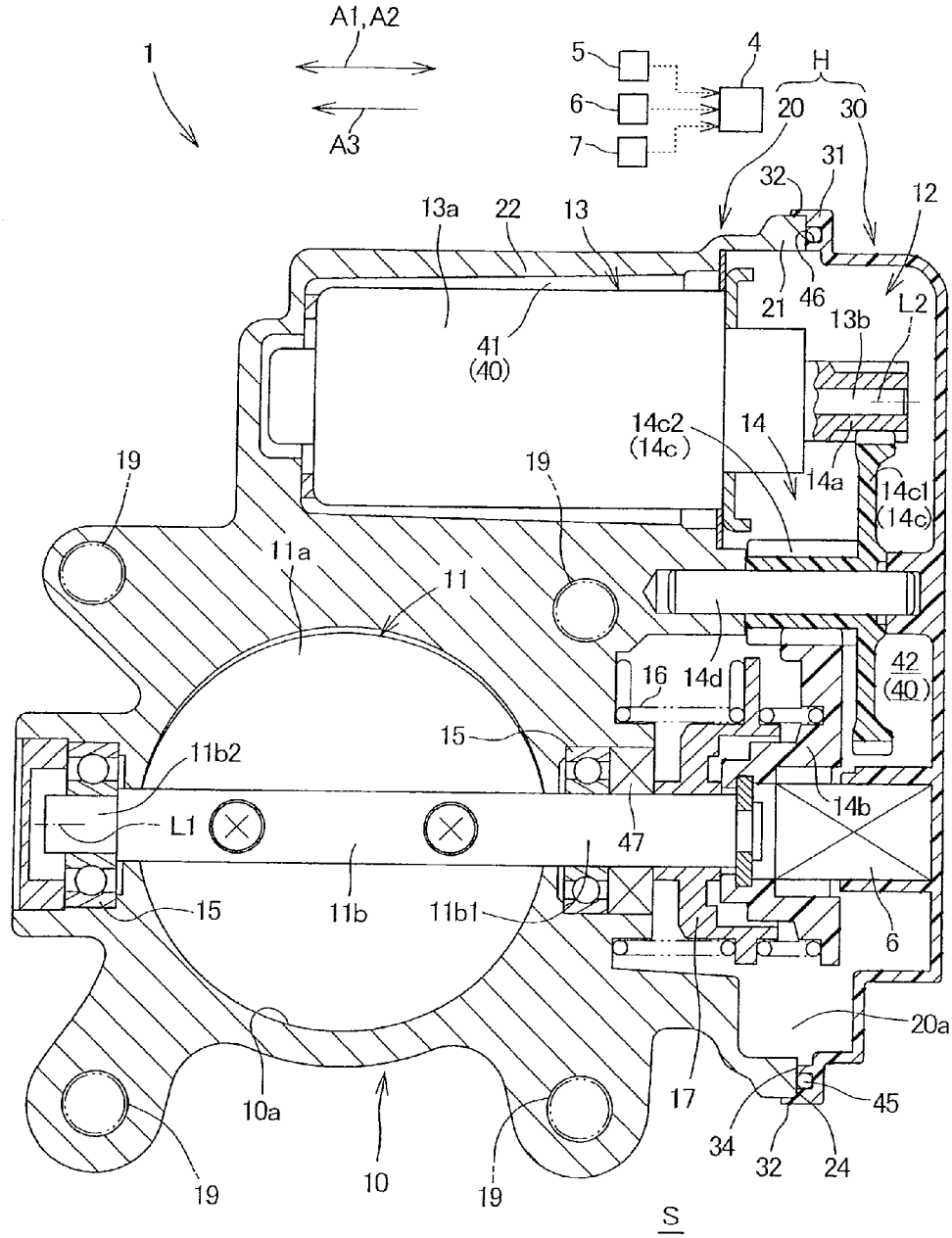
FIG. 1 is a partial sectional view of a throttle apparatus to which the present invention is applied and is a sectional view taken along line I-I of FIG. 2.
Figure 2:
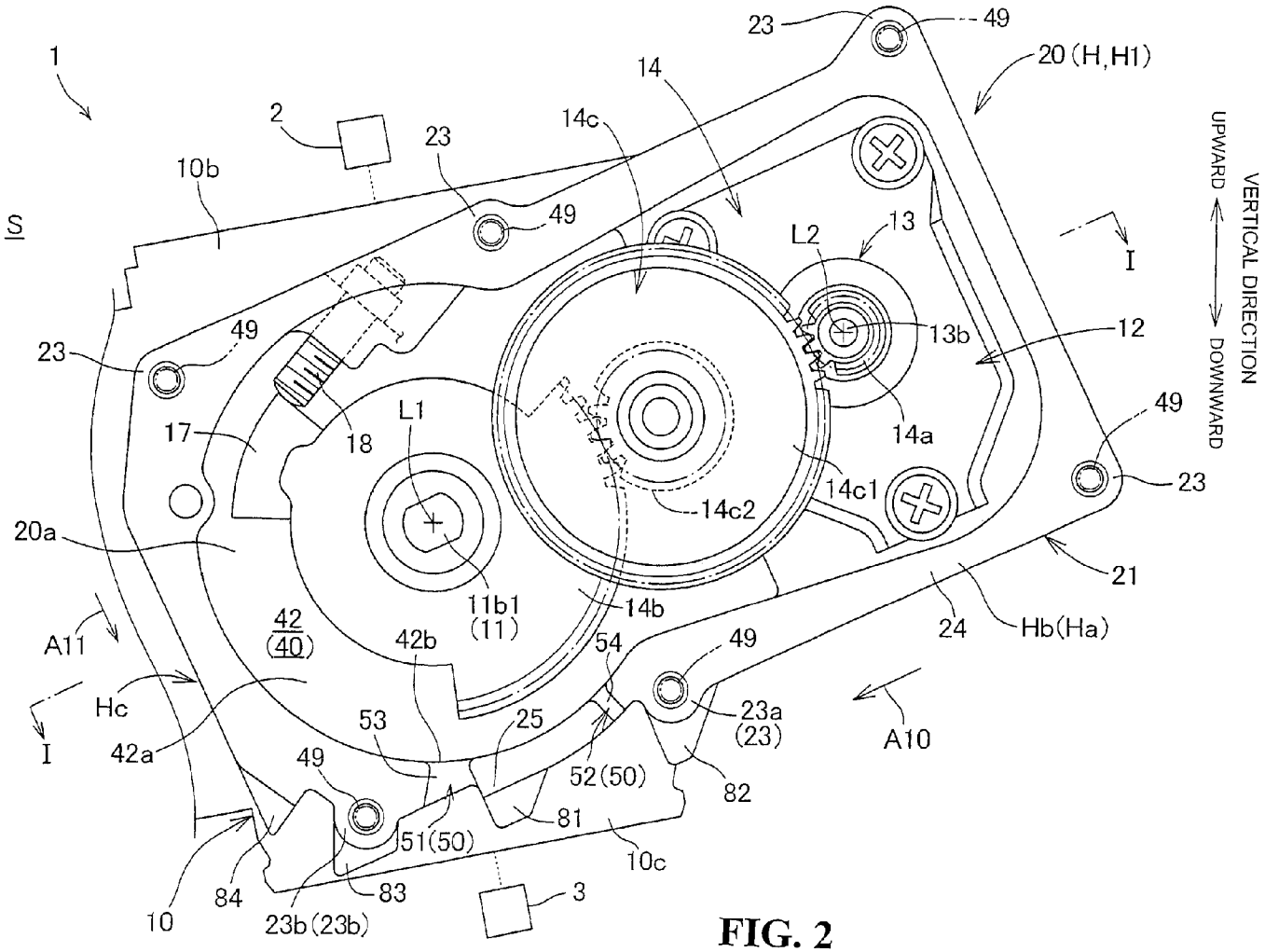
FIG. 2 is a view of the throttle apparatus of FIG. 1 with a cover removed as viewed in a particular horizontal direction.

Referring to FIGS. 1 and 2, a throttle apparatus 1 to which the present invention is applied includes an intake apparatus provided in an internal combustion engine. The internal combustion engine includes an engine body to which the intake apparatus is connected that is carried on a motorcycle.

The intake apparatus described above includes, in addition to the throttle apparatus 1, an air intake pipe 2 having an air cleaner, and a suction pipe 3 connected to the engine body described hereinabove in which a combustion chamber is formed. The intake apparatus defines an intake path as an air path for introducing external air taken in from the external space S through the air intake pipe 2 as air for combustion into the combustion chamber successively through the throttle apparatus 1 and the suction pipe 3.

The external space S is a space which surrounds the throttle apparatus 1 and accordingly a space in which the external air surrounding a throttle body 10 and a housing H hereinafter described exists, and is recognized as a space from which a covering space 70 hereinafter described is excepted for the convenience of description.

The throttle apparatus 1 includes a throttle body 10 which is a valve body which defines a throttle path 10*a* which is part of the intake path described above, a throttle valve 11 supported for movement, in the present embodiment, for pivotal motion in the throttle body 10 and disposed in the throttle path 10*a*, a driving apparatus 12 for driving the throttle valve 11, and a housing H for accommodating the driving apparatus 12.

The throttle valve 11 is driven by the driving apparatus 12 which operates under the control of a control apparatus 4 in response to an accelerator operation amount which is an instruction opening amount instructed by a driver and a driving condition including an engine driving condition of the internal combustion engine and a traveling state which is a state of the vehicle such that the opening thereof is controlled to control the flow rate of the air (hereinafter referred to as "air amount") flowing through the intake path in response to the acceleration operation amount, engine operation condition and traveling state.

The throttle body 10 formed from a metal or a synthetic resin, here from an aluminum alloy, is connected at one end portion 10*b* thereof to the air intake pipe 2 by a plurality of bolts 19 which are disposed around the throttle path 10*a* and extend through the throttle body 10 along the throttle path 10*a*, and is connected at the other end portion 10*c* thereof to the suction pipe 3.

The throttle valve 11 formed from a butterfly valve includes a valve plate 11*a* in the form of a disk disposed in the throttle path 10*a*, and a valve shaft 11*b* secured to the valve plate 11*a* and extending across the throttle path 10*a*. The valve shaft 11*b* is supported at the opposite shaft end portions 11*b*1 and 11*b*2 thereof on the throttle body 10 through bearings 15 and supported for movement, here for rotation, around a rotational center line L1 as a throttle axial line.

An adjustment screw 18 provided on the throttle body 10 adjusts the idling opening of the throttle valve 11 which is biased in a valve closing direction by a return spring 16.

The driving apparatus 12 includes an electric motor 13 as an actuator attached to the throttle body 10, and a transmission mechanism 14 for transmitting a driving force of the electric motor 13 to the throttle valve 11. The electric motor 13 includes a body 13*a*, and a drive shaft 13*b* in the form of a rotary shaft projecting from the body 13*a* and having a rotational center line L2 parallel to the rotational center line L1. The body 13*a* which includes a driving mechanism for driving the drive shaft 13*b* to rotate under the control of the control apparatus 4 is secured in a driving section accommodation unit 22 in such a state that the substantially entirety thereof is accommodated in a driving section accommodation chamber 41 which is defined by the driving section accommodation unit 22 provided integrally on the throttle body 10 by integral molding.

It is to be noted that the representation of "substantially" in the present specification includes a case which does not include the qualifier of "substantially" and a range which does not strictly coincide with the case which does not include the qualifier of "substantially" but does not have a significant difference in regard to the working-effect in comparison with the case which does not include the qualifier of "substantially."

The electric motor 13 is controlled by the control apparatus 4 to which detection signals are inputted from detection means which includes accelerator detection means 5 for detecting the accelerator operation amount, throttle opening detection means 6 for detecting the opening of the throttle valve 11 and driving state detection means 7 for detecting the driving condition including a vehicle speed as a traveling state and the engine driving state of the internal combustion engine described hereinabove.

The control apparatus 4 feedback controls the opening of the throttle valve 11 based on an actual opening of the throttle valve 11 detected by the throttle opening detection means 6 so that a basic setting opening determined in advance using the accelerator operation amount detected by the accelerator detection means 5 as a parameter is corrected in response to the driving condition detected by the driving state detection means 7 as occasion demands.

The drive shaft 13*b* is disposed on one side portion of the throttle body 10 in a pivotal motion center line direction A1 as the throttle axial line direction which is a direction crossing the throttle path 10*a* together with the transmission mechanism 14. In the present embodiment, the pivotal motion center line direction A1 extends substantially in parallel to a horizontal plane which is a plane orthogonal to the vertical direction, here extends in parallel to the horizontal plane.

The transmission mechanism 14 is a gear mechanism which forms a speed reducing mechanism and includes a driving gear wheel 14*a* as a driving rotational member provided on the drive shaft 13*b*, a driven gear wheel 14*b* made of a synthetic resin and serving as a driven rotational member provided at a shaft end portion 11*b*1, and an intermediate gear wheel 14*c* as an intermediate rotational member serving as an intermediate transmission member which forms a driving force transmission path between the driving gear wheel 14*a* and the driven gear wheel 14*b*. The intermediate gear wheel 14*c* made of a synthetic resin and supported for rotation on a support shaft 14*d* which is held by a case 20 and a cover 30 of the housing H is formed from a large gear wheel 14*c*1 which meshes with the driving gear wheel 14*a* and a small gear wheel 14*c*2 which meshes with the driven gear wheel 14*b* in the form of a segment gear wheel and rotates integrally with the large gear wheel 14*c*1.

The housing H includes the case 20 provided integrally on the throttle body 10 by integral molding, and the cover 30 coupled to the case 20 so as to cover a housing opening 20*a* defined by the case 20 from a direction (hereinafter referred to as "main horizontal direction") A2 parallel to a particular horizontal direction A3 hereinafter described which is one of horizontal directions or from the pivotal motion center line direction A1. In the present embodiment, the main horizontal direction A2 and the pivotal motion center line direction A1 coincide with each other.

The case 20 has a rectangular and annular case side peripheral portion 21 which defines the housing opening 20*a* as part thereof, and the driving section accommodation unit 22 described hereinabove. The cover 30 formed as a unitary member from a synthetic resin has, as part thereof, a rectangular and annular cover side peripheral portion 31 coupled to the peripheral portion 21.

In an accommodation chamber 40 defined by the case 20 and the cover 30, the electric motor 13 and the transmission mechanism 14, the throttle opening detection means 6, the return spring 16, and a transmission member 17 which is secured to the shaft end portion 11*b*1 to transmit spring force of the return spring 16 to the valve shaft 11*b* and to which the adjustment screw 18 is abutted are accommodated. The accommodation chamber 40 has the driving section accommodation chamber 41 in which the body 13*a* of the electric motor 13 is accommodated, and a transmission section accommodation chamber 42 in which the transmission mechanism 14, throttle opening detection means 6, return spring 16 and transmission member 17 are accommodated and which is in communication with the driving section accommodation chamber 41.

The case 20 and the cover 30 are coupled to each other in a state wherein coupling faces 24 and 34 (refer also to FIGS. 5 and 6) of the two peripheral portions 21 and 31 contact in face with each other at a plurality of boss elements 23 and 33 (refer also to FIGS. 3 and 4) provided on the peripheral portions 21 and 31, respectively, by bolts 49 which are fastening members as coupling members. The boss elements 23 and 33 are projecting portions which locally project toward an outer side direction from the peripheral portions 21 and 31, respectively.

The outer side direction is defined as a direction from the transmission section accommodation chamber 42 toward the external space S, which is partitioned from the accommodation chamber 40 by the housing H, across the two peripheral portions 21 and 31, and the inner side direction is defined as a direction from the external space S toward the transmission section accommodation chamber 42 across the two peripheral portions 21 and 31. The outer side direction and the inner side direction in the present embodiment are directions corresponding to a radially outward direction from and a radially inward direction to the rotational center line L1 or the rotational center line L2, respectively, and are directions parallel to a plane (hereinafter referred to as "orthogonal plane") orthogonal to the rotational center line L1 and the main horizontal direction A2, and the substantially entire coupling faces 24 and 34 extend substantially in parallel to the orthogonal direction.

The two coupling faces 24 and 34 are sealed liquid tight and air tight by an O-snap ring 45 serving as a seal member. The O-snap ring 45 is provided on one of the two peripheral portions 21 and 31, in the present embodiment, on the cover side peripheral portion 31 and is mounted in an annular seal groove 46 (refer also to FIGS. 3 to 6) which is open to the coupling face 34. The accommodation chamber 40 and the throttle path 10*a* are sealed liquid tight and air tight by a seal member 47 disposed around the shaft end portion 11*b*1 which projects into the transmission section accommodation chamber 42.

The throttle opening detection means 6 is attached to the cover 30, with connection terminal elements (not shown) electrically connected to the throttle opening detection means 6 and the electric motor 13 are provided on the cover 30. A detection signal, detected by the throttle opening detection means 6, is inputted to the control apparatus 4 and a driving signal from the control apparatus 4 is transmitted to the electric motor 13 through the connection terminal elements.

The throttle opening detection means 6 is a magnetic detection means which includes a detection object portion provided on the driven gear wheel 14*b* which rotates integrally with the throttle valve 11, and a detection portion for detecting the rotational position of the detection object portion and, for example, magnetically detects the rotational position of the detection object portion.

Figure 3:
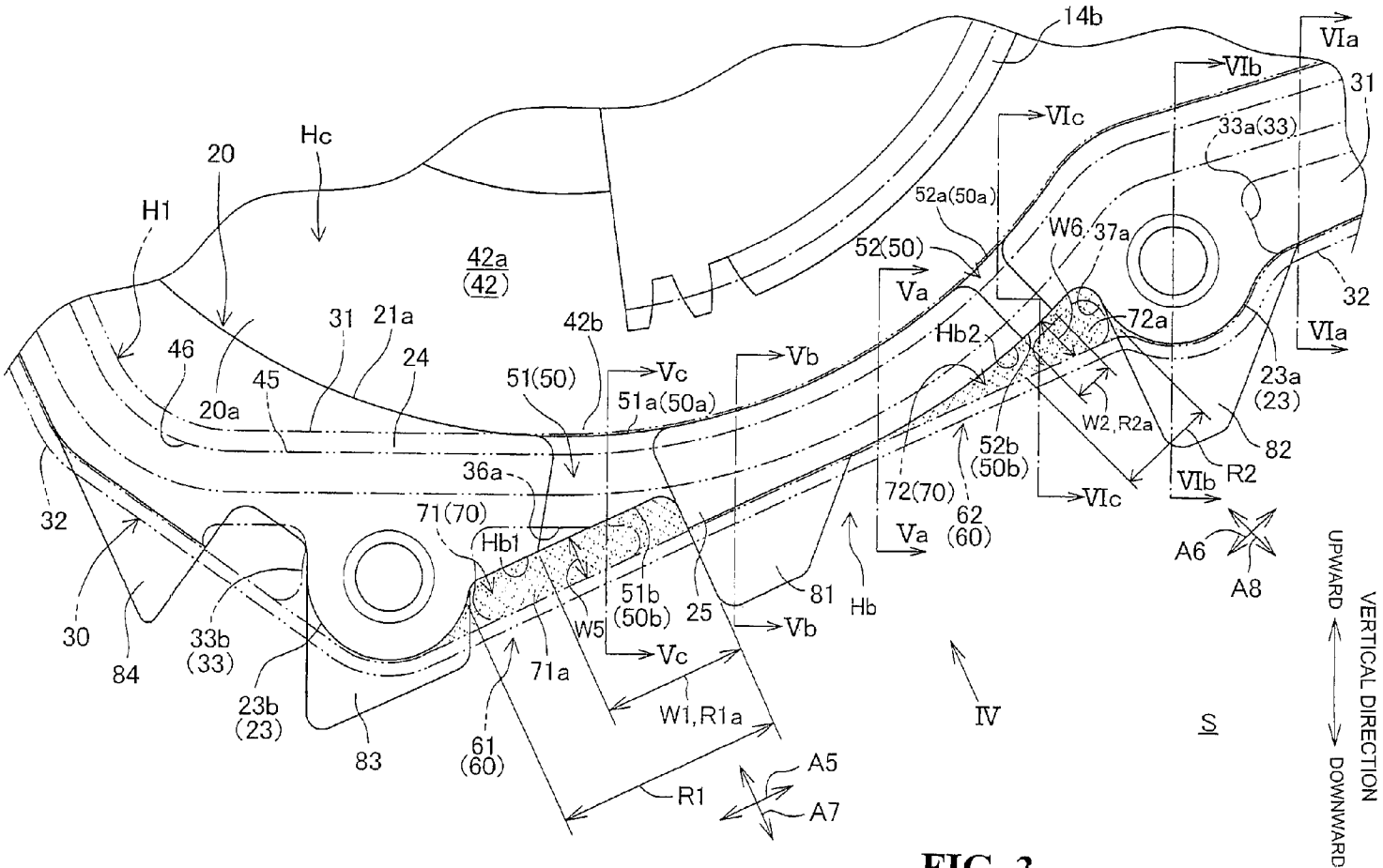
FIG. 3 is a partial enlarged view of FIG. 2 showing the cover indicated by alternate long and two short dashes lines.
Figure 4:
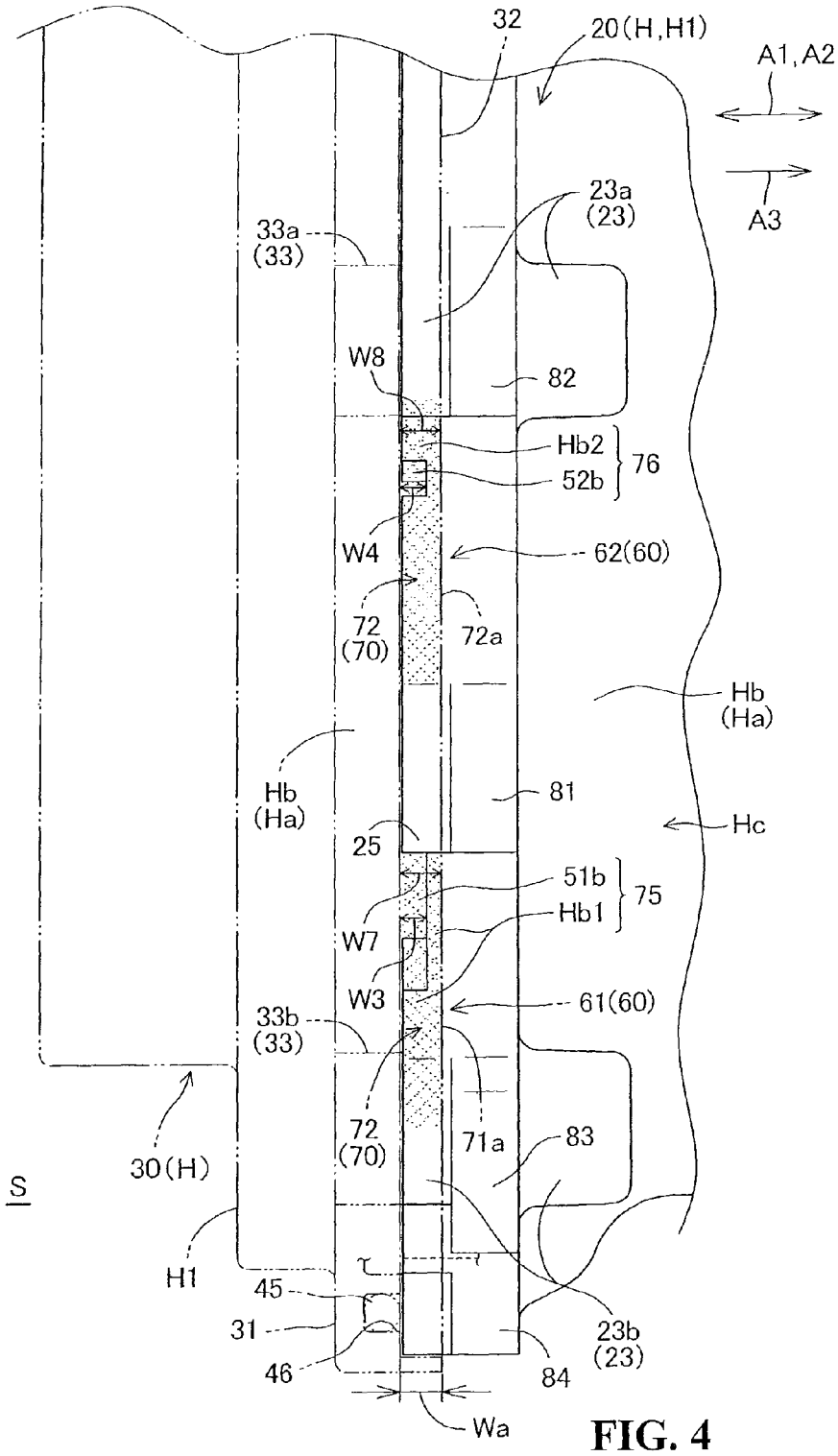
FIG. 4 is a partial view as viewed in a direction indicated by an arrow mark IV of FIG. 3.

Referring to FIGS. 3 and 4, the cover 30 has, as part thereof, a rib wall 32 (refer also to FIGS. 1, 5 and 6) provided integrally on the peripheral portion 31 by integral molding. The rib wall 32 is an annular wall which surrounds an outer peripheral face of the peripheral portion 21 over the overall periphery from the outer side direction on the outer periphery side of the case side peripheral portion 21. The rib wall 32 projects in the main horizontal direction A2 (or the pivotal motion center line direction A1) from the coupling face 34 and extends in parallel to the main horizontal direction A2 with a projection width Wa farther than the coupling face 24 of the case side peripheral portion 21 such that the rib wall 32 covers a portion of the case side peripheral portion 21 rather near to the coupling face 24 from the outer side direction and substantially contacts with the peripheral portion 21 over most part of the peripheral portion 21 except a covering wall 60 hereinafter described. Although the projection width Wa in the present embodiment is uniform over the overall periphery, it may be partially different as another example.

Since part of the cover side peripheral portion 31 and part of the rib wall 32 form the covering wall 60 (refer also to FIGS. 5 and 6), the housing H composed of the case 20 and the cover 30 has the covering wall 60 which is part of the cover 30 and a housing body H1 other than the covering wall 60. Therefore, the housing body H1 is composed of the case 20 and the portion of the cover 30 other than the covering wall 60.

Figure 5A:
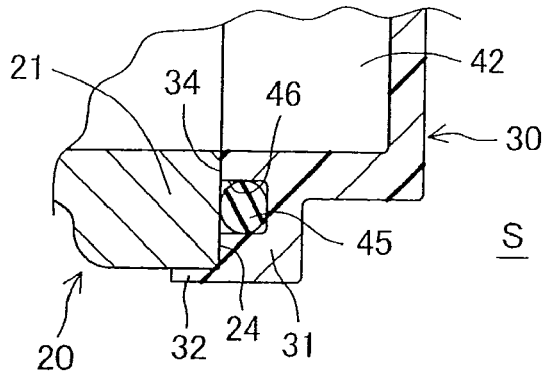
FIG. 5(*a*) is a sectional view taken along line Va-Va of FIG. 3.
Figure 5B:
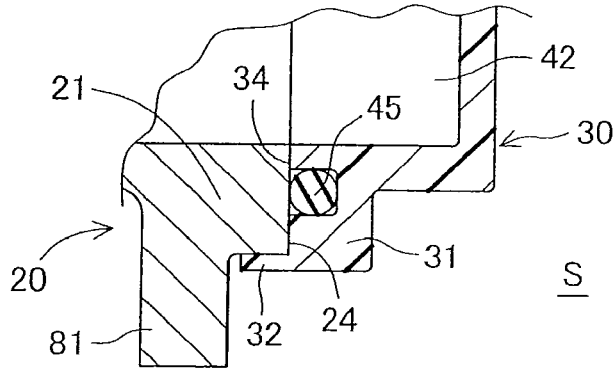
Figure 5C:
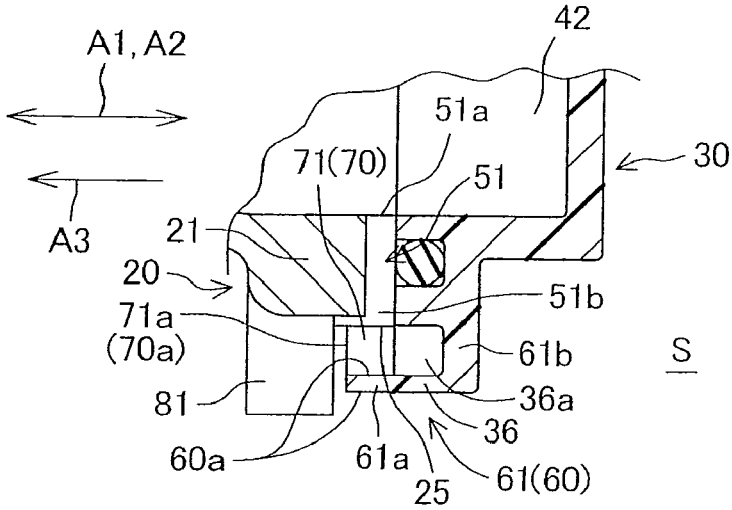
Figure 6A:
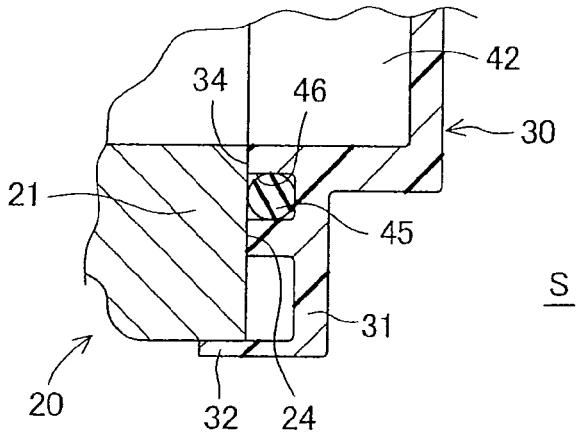
FIG. 6(*a*) is a sectional view taken along line VIa-VIa of FIG. 3.
Figure 6B:
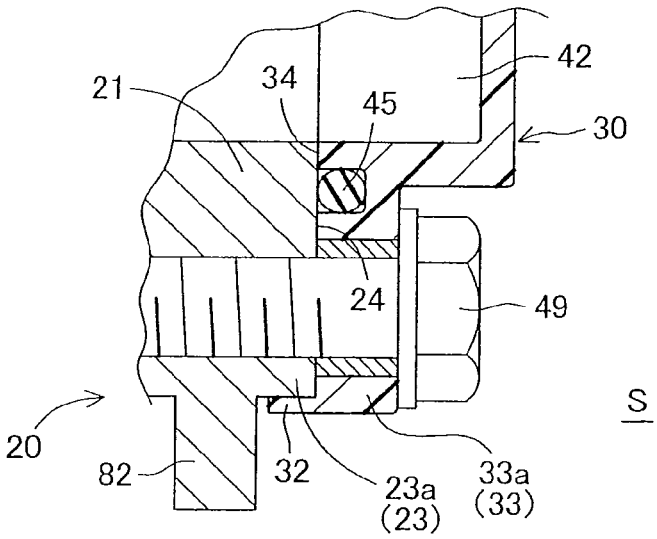
Figure 6C:
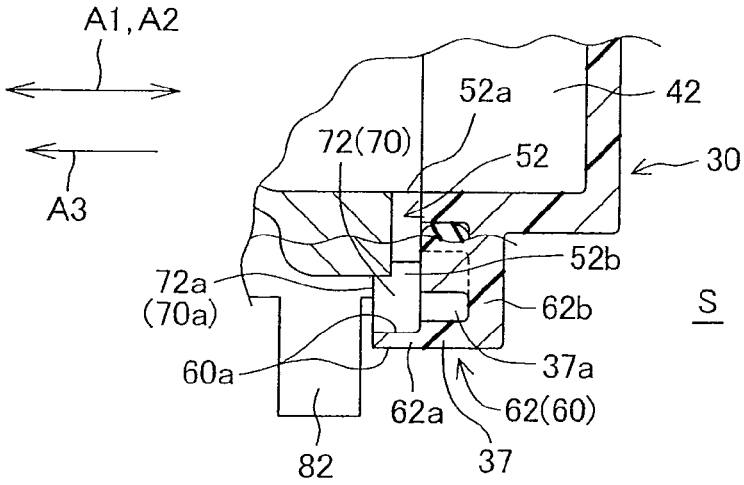

Further, an outer face of the housing H has a body outer face Ha of the housing body H1 which faces the external space S and a wall face 60*a* (refer to FIG. 5(*c*) and FIG. 6(*c*)) of the covering wall 60. Therefore, the outer face of the housing H is a face of the housing H which contacts with the external space S or the covering space 70.

The body outer face Ha has a lower outer face Hb which faces vertically downwardly, that is, is directed vertically downwardly.

Referring to FIGS. 2 to 4, in a lower wall Hc of the housing H which defines a lower chamber 42*a* which includes a lowermost portion 42*b* of the transmission section accommodation chamber 42 of the accommodation chamber 40 in the vertical direction, a predetermined number of ventilation paths 50 are provided which is greater than 1 for communicating the external space S and the accommodation chamber 40 with each other for the ventilation and the pressure adjustment of air in the accommodation chamber 40. In the present embodiment, the ventilation paths 50 are formed from a plurality of, that is, two, first and second ventilation paths 51 and 52. The ventilation paths 51 and 52 are separate communicating paths disposed at different positions of the housing H and are positioned between boss elements 23*a* and 23*b*; 33*a* and 33*b* which are positioned neighboring with each other in a circumferential direction of the peripheral portions 21 and 31 (or in a circumferential direction of the housing opening 20*a*).

A lower wall He is a portion of the housing H, and hence of the case 20 and the cover 30, which is positioned vertically lower than the rotational center line L1 and the rotational center line L2 in the vertical direction.

The first and second ventilation paths 51 and 52 are provided in the lower wall Hc of the housing body H1.

The first and second ventilation paths 51 and 52 are formed from grooves 53 and 54 provided at the case side peripheral portion 21 of the lower wall He which is at least one of the peripheral portions 21 and 31 such that they are open to the coupling face 24 of the case side peripheral portion 21, and the cover side peripheral portion 31 as the other one of the peripheral portions 21 and 31 which covers the grooves 53 and 54 from a horizontal direction.

The ventilation paths 51 and 52 extend in the vertical direction or in a direction inclined at an acute angle with respect to the vertical direction. In the present embodiment, the first ventilation path 51 extends in the vertical direction and the second ventilation path 52 extends in the inclined direction. Further, the ventilation paths 51 and 52 have upper end openings 51*a* and 52*a* as inner end openings open to the transmission section accommodation chamber 42, and lower end openings 51*b* and 52*b* as outer end openings positioned vertically downwardly with respect to the upper end openings 51*a* and 52*a* and open to the external space S. Accordingly, the upper end openings 51*a* and 52*a* are open to an inner face 21*a* of the peripheral portion 21 of the lower wall Hc, and the lower end openings 51*b* and 52*b* are open to the lower outer face Hb of the peripheral portion 21 of the lower wall Hc. Meanwhile, upper end openings 50*a* as inner end openings of the ventilation paths 50 are formed from the upper end openings 51*a* and 52*a*, and lower end openings 50*b* as outer end openings of the ventilation paths 50 are formed from the lower end openings 51*b* and 52*b*.

The upper end opening 51*a* of the first ventilation path 51 is open substantially to the lowermost portion 42*b* of the transmission section accommodation chamber 42 and serves also as a drain path for allowing water intruding in the accommodation chamber 40 to flow out to the external space S. The upper end opening 52*a* and the lower end opening 52*b* of the second ventilation path 52 are positioned vertically higher than the upper end opening 51*a* of the first ventilation path 51 and have a minimum path area smaller than the minimum path area of the first ventilation path 51.

In a state wherein the internal combustion engine described above is carried on the motorcycle, the throttle body 10 and the housing H are partly covered with a fuel tank and a vehicle body cover from a vertically upward direction and a horizontal direction. However, it cannot be fully prevented that water such as rainwater flies through a gap between the fuel tank and the vehicle body cover or some other portion or water drops from the gap until the water adheres to the housing H, that is, the housing H is exposed to the water.

Therefore, the outer face of the housing H is a face having an outer face portion to which water in the external space S can adhere as adhering water including the body outer face Ha which is an outer face of the housing body H1. If the housing body H1 is exposed to water, the water flying to the housing body H1 or the water adhering to the body outer face Ha forms a water film in such a manner as to close up the lower end openings 51*b* and 52*b* of the first and second ventilation paths 51 and 52, then when the pressure in the accommodation chamber 40 drops because of a temperature variation or the like, the water intrudes into the transmission section accommodation chamber 42 and hence into the accommodation chamber 40 through the ventilation paths 51 and 52.

Therefore, from a point of view of suppressing intrusion of water into the accommodation chamber 40 through the ventilation paths 51 and 52, the cover 30 which is a component of the housing H has a covering wall 60 as part thereof in order to suppress the formation of a water film at the lower end openings 51*b* and 52*b*. The covering wall 60 is composed of more than one cover wall, here two first and second covering walls 61 and 62 as a plurality of cover walls, which cover the entire lower end openings 51*b* and 52*b* of the first and second ventilation paths 51 and 52 and covering object regions 75 and 76 of the lower outer face Hb, which are formed from peripheral faces Hb1 and Hb2 of the lower end openings 51*b* and 52*b*, from a vertically downward direction.

The first and second covering walls 61 and 62 form first and second covering spaces 71 and 72 (indicated by cross hatching broken lines in FIGS. 3 and 4) which cooperate with the peripheral portions 21 and 31 to form the covering space 70. The covering walls 61 and 62 connect to the rib wall 32 and the peripheral portion 31, which are part of the housing body H1, on the upstream side with respect to the lower end openings 51*b* and 52*b* in the covering object regions 75 and 76 or the covering spaces 71 and 72 so that, when adhering water adhering to the lower outer face Hb flows down along the lower outer face Hb toward the covering walls 61 and 62, the adhering water may not flow into the covering spaces 71 and 72 from the upstream side with respect to the lower end openings 51*b* and 52*b* in the covering object regions 75 and 76 or the covering spaces 71 and 72.

It is to be noted that, in the present specification and the claim, the upstream and the downstream are described in regard to a flow of adhering water which adheres to the body outer face Ha of the housing body H1 and flows down in flowing directions A10 and A11 (refer to FIG. 2) along the body outer face Ha including the lower outer face Hb under the gravity.

Therefore, between the first and second covering walls 61 and 62 and the first and second covering object regions 75 and 76 in the vertical direction, the covering spaces 71 and 72 to which the lower end openings 51*b* and 52*b* of the ventilation paths 51 and 52 are open are formed, respectively, and the ventilation paths 51 and 52 carry out ventilation between the accommodation chamber 40 and the external space S through the covering spaces 71 and 72. Since the covering spaces 71 and 72 are formed from the covering walls 61 and 62 provided on the cover side peripheral portion 31 which is a portion coupled to the case 20 for the ventilation paths 51 and 52 formed by cooperation of the case 20 and the cover 30, they can be formed in a simple structure.

Referring also to FIG. 5(*c*) and FIG. 6(*c*), in the covering spaces 71 and 72 to which the lower end openings 51*b* and 52*b* of the ventilation paths 51 and 52 are open, the vertically downward side thereof is covered with lower covering walls 61*a* and 62*a* which are part of the rib wall 32 and serve as spaced portions spaced vertically downwardly from the peripheral portions 21 and 31, the particular horizontal direction A3 side thereof which is one side in the main horizontal direction A2 forms first and second open ports 71*a* and 72*a* which are open ports 70*a* open to the external space S toward the particular horizontal direction A3, and the opposite side to the particular horizontal direction A3 which is the other side in the main horizontal direction A2 is closed up with sideward covering walls 61*b* and 62*b* which are extensions of the peripheral portion 31. The sideward covering walls 61*b* and 62*b* extend in an outer direction from the coupling face 34.

Therefore, the covering walls 61 and 62 which cooperate with the peripheral portions 21 and 31 to define the covering spaces 71 and 72 are composed of the lower covering walls 61*a* and 62*a* which define the covering spaces 71 and 72 at a vertically downward location and the sideward covering walls 61*b* and 62*b* which define the covering spaces 71 and 72 in the main horizontal direction A2. Recessed portions 36 and 37 which define recessed spaces 36*a* and 37*a* which are open to the covering spaces 71 and 72 are provided on the sideward covering walls 61*b* and 62*b*, respectively.

Referring to FIGS. 3 and 4, the maximum opening widths W1 and W2 of the open ports 71*a* and 72*a* are set to such sizes that, even if adhering water flowing down toward the covering walls 61 and 62 along the lower outer face Hb or water drops flying to the open ports 71*a* and 72*a* tend to form a water film at the open ports 71*a* and 72*a*, the water is cut into pieces between the lower covering walls 61*a* and 62*a* and the peripheral portion 21 across the open ports 71*a* and 72*a* in the vertical direction by the surface tension thereof and therefore cannot form a water film which closes up the open ports 71*a* and 72*a*. Further, the flying of water from the particular horizontal direction A3 to the open ports 71*a* and 72*a* is suppressed by the throttle body 10 (refer to FIG. 2) serving as a shielding member which is opposed to the open ports 71*a* and 72*a* in the particular horizontal direction A3.

More specifically, with regard to the first and second ventilation paths 51 and 52, the open ports 71*a* and 72*a* which are open to the external space S toward the particular horizontal direction A3 between the covering object regions 75 and 76 and the covering walls 61 and 62 in the vertical direction have an opening area greater than the opening area of the lower end openings 51*b* and 52*b* within the opening ranges R1*a* and R2*a* of the lower end openings 51*b* and 52*b* in directions A5 and A6 in the particular horizontal direction (A3) in which the lower end openings 51*b* and 52*b* have the maximum opening widths W1 and W2 as viewed from the particular horizontal direction A3 (that is, the main horizontal direction A2).

The opening widths W5 and W6 of the open ports 71*a* and 72*a* in directions A7 and A8 orthogonal to the directions A5 and A6 in the particular horizontal direction (A3) as viewed from the particular horizontal direction A3 are greater than the opening widths W3 and W4 of the lower end openings 51*b* and 52*b* in the particular horizontal direction A3 within the predetermined ranges R1 and R2 which include the opening ranges R1*a* and R2*a* and are wider than the opening ranges R1*a* and R2*a* in the directions A5 and A6 in the particular horizontal direction (A3). In the present embodiment, the maximum opening width W1 is greater than the maximum opening width W2 and the two opening widths W3 and W4 are substantially equal to each other.

In the first covering space 71, the predetermined range R1 is a range from an uppermost portion of the lower end opening 51*b* of the ventilation path 51 to a vertically downward (or downstream) location below the lowermost portion exceeding the lowermost portion, and the opening width W5 is substantially uniform over the substantially overall predetermined range R1. In the second covering space 72, the predetermined range R2 is a range from a lowermost portion of the lower end opening 52*b* of the ventilation path 52 to a vertically upward (or upstream) location above an uppermost portion of the lower end opening 52*b* exceeding the uppermost portion, and the opening width W6 increases toward the upstream on the upstream side with respect to the lower end opening 52*b*.

In the present embodiment, the first and second covering spaces have widths in the orthogonal directions A7 and A8 substantially equal to the opening widths W5 and W6 over the overall width between the first and second covering spaces in the main horizontal direction.

Further, as shown in FIG. 4, the depths W7 and W8 of the covering spaces 71 and 72 in the main horizontal direction A2 are equal to the projection width Wa and greater by more than ½ the opening widths W3 and W4, preferably by more than ⅔ the opening widths W3 and W4, than the opening widths W3 and W4 of the lower end openings 51*b* and 52*b* in the main horizontal direction A2. Therefore, the lower covering walls 61*a* and 62*a* extend by a predetermined projecting amount greater than ½, preferably than ⅔, the opening widths W3 and W4 for the lower end openings 51*b* and 52*b* in the particular horizontal direction A3 and accordingly extend in a hood-like form.

Referring to FIGS. 2 to 4, the case side peripheral portion 21 which is part of the housing body H1 has a first projection 81 positioned on the upstream with respect to the first covering space 71 and a second projection 82 positioned on the upstream with respect to the first projection 81 and the second covering space 72. The first projection 81 projects vertically downwardly farther than the lower end opening 51*b* of the first ventilation path 51 while the second projection 82 projects vertically downwardly farther than the lower end opening 52*b* of the second ventilation path 52.

Further, the case side peripheral portion 21 has a third projection 83 positioned on the downstream with respect to the first projection 81 and the first covering space 71, and a fourth projection 84 positioned on the opposite side to the first projection 81 with the third projection 83 therebetween in a circumferential direction of the peripheral portion 21 (or in a circumferential direction of the housing opening 20*a*). The third projection 83 is positioned most vertically downwardly among the first to fourth projections 81 to 84 and projects vertically downwardly from the lowermost portion of the peripheral portion 21.

As viewed from the particular horizontal direction A3, or in a circumferential direction of the housing opening 20*a*, the first covering space 71 is formed between the first and third projections 81 and 83 while the second covering space 72 is formed between the first and second projections 81 and 82.

Referring also to FIGS. 5 and 6, the projections 81 to 84 each in the form of a plate extending substantially in parallel to the orthogonal plane described hereinabove which extends orthogonally to the main horizontal direction A2 are positioned in the particular horizontal direction A3 in the proximity of the lower covering walls 61*a* and 62*a* and the rib wall 32 in the main horizontal direction A2, that is, in contact with or in a spaced relationship with a small gap left from the lower covering walls 61*a* and 62*a* and the rib wall 32. The gap just mentioned has a distance of such a degree that water forms a water film which closes up the gap between the lower covering walls 61*a* and 62*a* and the rib wall 32 and projections 81 to 84.

If adhering water flowing along the lower outer face Hb reaches the first and second projections 81 and 82, then it adheres to and flows down along side faces of the projections 81 and 82 rather near to the open ports 71*a* and 72*a* in the main horizontal direction A2 thereby to promote adhesion of the adhering water to the projections 81 and 82.

The adhering water flowing down along the projections 81 to 84 drops from lower end portions of the projections 81 to 84.

Therefore, the first to fourth projections 81 to 84 function as draining projections. The first and second projections 81 and 82 suppress the adhering water flowing down along the lower outer face Hb from forming a water film at the open ports 71*a* and 72*a* and the lower end openings 51*b* and 52*b* positioned in the proximity of or immediately on the downstream of the projections 81 and 82.

Meanwhile, the peripheral portions 21 and 31 have a protrusion 25 which projects vertically downwardly farther than the lower end openings 51*b* and 52*b*, the boss element 23*b* as a protrusion which projects vertically downwardly farther than the lower end opening 51*b* of the first ventilation path 51 and the boss element 23*a* as a protrusion which projects vertically downwardly farther than the lower end opening 52*b* of the second ventilation path 52, at positions the same as those of the first to third projections 81 to 83 in a circumferential direction of the housing opening 20*a*. The protrusion 25 forms an upstream wall which defines the upstream side of the first covering space 71 while the boss element 23*b* forms a downstream wall which defines the downstream side of the first covering space 71 and the boss element 23*a* forms an upstream wall which defines the upstream side of the second covering space 72.

The operation and effects of the present embodiment configured in such a manner as described above are described hereinbelow.

In the throttle apparatus 1 which includes the housing H which defines the accommodation chamber 40 in which the transmission mechanism 14 which transmits driving force of the electric motor 13 for driving the throttle valve 11 which controls the flow rate of air to flow through the intake path of the internal combustion engine to the throttle valve 11 is accommodated, the first and second ventilation paths 51 and 52 for communicating the external space S and the accommodation chamber 40 with each other are provided in the housing H. The housing H has the body outer face Ha including an outer face portion to which water in the external space S can adhere as adhering water and has the peripheral portions 21 and 31 of the housing body H1 in which the ventilation paths 51 and 52 are provided and the covering walls 61 and 62 which cooperate with the peripheral portions 21 and 31 to form the first and second covering spaces 71 and 72 which have the open ports 71*a* and 72*a* which are open to the external space S. The lower end openings 51*b* and 52*b* of the ventilation paths 51 and 52 are open to the covering spaces 71 and 72 at the lower outer face Hb of the body outer face Ha which faces vertically downwardly. The covering walls 61 and 62 cover the covering object regions 75 and 76, which include the entire lower end openings 51*b* and 52*b* and the peripheral faces Hb1 and Hb2 of the lower end openings 51*b* and 52*b* on the lower outer face Hb from vertically downwardly and connect to the peripheral portion 31 and the rib wall 32 on the upstream side with respect to the first and second covering spaces 71 and 72. The open ports 71*a* and 72*a* are open toward the particular horizontal direction A3 and have opening areas greater than the opening areas of the lower end openings 51*b* and 52*b* within the opening ranges R1*a* and R2*a* of the lower end openings 51*b* and 52*b* in the maximum width directions A5 and A6 within which the lower end openings 51*b* and 52*b* have the maximum opening widths W1 and W2 as viewed from the particular horizontal direction A3.

By the structure described above, since the lower end openings 51*b* and 52*b* of the ventilation paths 51 and 52 which communicate the accommodation chamber 40 in which the transmission mechanism 14 is accommodated and the external space S with each other are open to the lower outer face Hb of the outer face of the housing body H1 and are open to the covering spaces 71 and 72 defined by being covered from vertically downwardly with the covering walls 61 and 62 and the covering walls 61 and 62 connect to the peripheral portion 31 and the rib wall 32, which are part of the housing body H1, on the upstream side with respect to the lower end openings 51*b* and 52*b* in the covering spaces 71 and 72, adhering water flowing down along the lower outer face Hb is prevented from flowing into the covering spaces 71 and 72 from the upstream side in the covering spaces 71 and 72. Therefore, water drops flying to portions of the housing body H1 in the proximity of the peripheral portions 21 and 31 and adhering water adhering to and flowing down along the body outer face Ha of the housing body H1 are suppressed from intruding into the ventilation paths 51 and 52 through the lower end openings 51*b* and 52*b*.

Further, since the opening areas of the open ports 71*a* and 72*a* of the covering spaces 71 and 72 are greater than the opening areas of the lower end openings 51*b* and 52*b* of the ventilation paths 51 and 52 in the maximum width directions A5 and A6 within the opening ranges R1*a* and R2*a* which correspond to the positions of the lower end openings 51*b* and 52*b*, while a required ventilation function is assured, also where the opening areas of the lower end openings 51*b* and 52*b* are small in order to suppress intrusion of water, the lower end openings 51*b* and 52*b* are in communication with the external space S through the open ports 71*a* and 72*a* of the covering spaces 71 and 72. Therefore, in comparison with an alternative case wherein the lower end openings 51*b* and 52*b* are exposed to the external space S, adhering water flowing down along the body outer face Ha is suppressed from forming a water film at the open ports 71*a* and 72*a*. Accordingly, the formation of a water film at the lower end openings 51*b* and 52*b* is suppressed and the intrusion suppression effect against water intruding into the accommodation chamber 40 through the ventilation paths 51 and 52 is improved.

Since the opening widths W5 and W6 of the open ports 71*a* and 72*a* in the orthogonal directions A7 and A8 orthogonal to the maximum width directions A5 and A6 as viewed from the particular horizontal direction A3 include the opening ranges R1*a* and R2*a* and are greater than the opening widths W3 and W4 of the lower end openings 51*b* and 52*b* in the particular horizontal direction A3 within the predetermined ranges R1 and R2 which are wider than the opening ranges R1*a* and R2*a*, the opening widths W5 and W6 of the open ports 71*a* and 72*a* are greater over the predetermined ranges R1 and R2 which are wider than the opening ranges. Consequently, the opening areas of the open ports 71*a* and 72*a* become further greater than the opening areas of the lower end openings 51*b* and 52*b*, and adhering water is suppressed from forming a water film at the open ports 71*a* and 72*a* and the intrusion suppression effect against water intruding into the accommodation chamber 40 through the ventilation paths 51 and 52 is improved.

Since the open ports 71*a* and 72*a* are set to such a size that adhering water flowing along the lower outer face Hb toward the covering walls 61 and 62 is cut into pieces between the covering walls 61 and 62 and the peripheral portion 21 of the housing body H1 across the open ports 71*a* and 72*a*, the adhering water is cut into pieces between the covering walls 61 and 62 and the housing body H1 across the open ports 71*a* and 72*a* and is suppressed from forming a water film which closes up the open ports 71*a* and 72*a*. Consequently, the intrusion suppression effect against water intruding into the accommodation chamber 40 through the ventilation paths 51 and 52 is further improved.

Since the first and second ventilation paths 51 and 52 provided separately from each other are provided in the housing H such that the ventilation paths 51 and 52 are open to the first and second covering spaces 71 and 72, respectively, and the first ventilation path 51 serves also as a water draining path for allowing water in the accommodation chamber 40 to flow out into the external space S, discharge of water from the first ventilation path 51 which serves also as a water draining path from the accommodation chamber 40 is promoted by ventilation between the accommodation chamber 40 and the external space S by the second ventilation path 52. In addition, since the first and second ventilation paths 51 and 52 are open to the covering spaces 71 and 72, intrusion of water into the accommodation chamber 40 through the ventilation paths 51 and 52 is suppressed.

Further, since the second ventilation path 52 is positioned vertically upwardly with respect to the first ventilation path 51 and has a minimum path area smaller than the minimum path area of the first ventilation path 51, discharge of water from the first ventilation path 51 which is positioned vertically downwardly with respect to the second ventilation path 52 is promoted by the fact that the minimum path area of the first ventilation path 51 is greater than the minimum path area of the second ventilation path 52. Further, since the minimum path area of the second ventilation path 52 positioned vertically upwardly with respect to the first ventilation path 51 is smaller than that of the first ventilation path 51, intrusion of water into the accommodation chamber 40 through the second ventilation path 52 is suppressed.

The covering walls 61 and 62 are a first covering wall 61 and a second covering wall 62, and the covering spaces 71 and 72 are a first covering space 71 which is defined by the first covering wall 61 and to which the first ventilation path 51 is open and a second covering space 72 which is defined by the second covering wall 62 and to which the second ventilation path 52 is open. The housing body H1 has the first projection 81 positioned on the upstream with respect to the first covering space 71 and the second projection 82 positioned on the upstream with respect to the first projection 81 and the second covering space 72. The first projection 81 projects vertically downwardly farther than the lower end opening 51*b* of the first ventilation path 51 and the second projection 82 projects vertically downwardly farther than the lower end opening 52*b* of the second ventilation path 52.

By the structure just described, since the first and second projections 81 and 82 carry out a draining action of adhering water, intrusion of water into the first and second ventilation paths 51 and 52 is suppressed. Further, since the covering spaces 71 and 72 are formed on the downstream side with respect to the projections 81 and 82, formation of a water film at the open ports 71*a* and 72*a* of the covering spaces 71 and 72 is further suppressed and the intrusion suppression effect against water is improved.

The sideward covering walls 61*b* and 62*b* which are formed making use of the peripheral portion 31 of the cover 30 on the covering walls 61 and 62 have the recessed spaces 36*a* and 37*a* provided thereon such that they are open to the covering spaces 71 and 72. Consequently, since the ventilation paths 51 and 52 are in communication with the spaces in the covering walls 61 and 62 which are greater by amounts corresponding to the recessed spaces 36*a* and 37*a* open to the covering spaces 71 and 72 in comparison with those in an alternative case wherein only the covering spaces 71 and 72 are provided, the pressure variation caused in the covering spaces 71 and 72 through the ventilation paths 51 and 52 by a pressure variation of the accommodation chamber 40 decreases. As a result, when the pressure in the accommodation chamber 40 drops, the force for sucking water through the open ports 71*a* and 72*a* decreases. Consequently, the intrusion suppression effect against water intruding into the accommodation chamber 40 through the ventilation paths 51 and 52 is improved.

In the following, forms wherein the configuration of part of the embodiment described hereinabove is altered are described in regard to the altered configuration.

The number of ventilation paths may be one or a predetermined plurality of ventilation paths other than 2. Where the predetermined number of ventilation paths are provided, a number of covering spaces equal to the predetermined number may be provided individually corresponding to the ventilation paths, or where a number of covering spaces smaller than the predetermined number are provided, two or more ventilation paths may be open to one covering space such that the predetermined number of ventilation paths are open to the covering spaces.

The second ventilation path 52 may not be open to the second covering space 72, and the first ventilation path 51 may not open to the first covering space 71.

The first covering space 71 may be positioned between a pair of projections which are positioned adjacent each other in a circumferential direction of the housing opening 20*a* while the second covering space 72 is positioned between a pair of projections which are different from the first-mentioned pair of projections and are positioned adjacent each other in the circumferential direction of the housing opening 20*a*.

The first open port 71*a* of the first covering space 71 may be provided at the lower end opening 51*b* or on the upstream side with respect to the lower end opening 51*b* and may have such a shape that the opening width W5 thereof increases toward the upstream side.

The ventilation path may be defined by a groove provided on the cover side peripheral portion 31 and the case side peripheral portion 21 or may be defined by grooves provided on both of the peripheral portions 21 and 31. Further, the ventilation path may be formed only on the case 20 or only on the cover 30 without being formed by cooperation of the case side peripheral portion 21 and the cover side peripheral portion 31.

The projecting wall and the covering wall may be provided on the case 20, and further, the covering wall may be formed from a portion other than the projecting wall.

While the covering space in the embodiment described hereinabove has the open port only on one side in the main horizontal direction A2, it may otherwise have open ports on the opposite sides in the main horizontal direction A2.

The throttle apparatus may include, as a valve system thereof, a throttle valve as a flow rate control valve for controlling the flow rate of air or gas other than the air for combustion in the internal combustion engine. Further, the throttle apparatus may include a throttle valve as a flow rate control valve which controls the flow rate of fluid which flows along a fluid path in a machine other than the internal combustion engine.

The case which has a path forming member and forms the housing H may be formed from a member separate from the throttle body. In addition, the case may be provided on the throttle body by being attached to the throttle body.

Where the ventilation path does not serve also as a water draining path, the inner end opening thereof may be positioned vertically downwardly with respect to the outer end opening in the upward and downward direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A throttle apparatus having a throttle body for supporting a throttle valve for controlling the flow rate of air to flow through an air path, a driving apparatus having an actuator for driving said throttle valve and a transmission mechanism for transmitting a driving force of said actuator to said throttle valve, and a housing in which a ventilation path for communicating an accommodation chamber in which said transmission mechanism is accommodated and an external space with each other is provided, comprising:

said housing includes a housing body having a body outer face having an outer face portion to which water in the external space can adhere and in which said ventilation path is provided and a covering wall for cooperating with said housing body to define a covering space having an open port opened to the external space;

an outer end opening of said ventilation path opened to the covering space at a lower outer face of the body outer face which faces vertically downwardly;

said covering wall covers a covering region, including the entire outer end opening and a peripheral face of the lower outer face around the outer end opening, from vertically downwardly and connects to said housing body on the upstream side with respect to the outer end opening in the covering region in regard to a flow of the adhering water which flows down along the lower outer face; and the open port is opened toward a particular horizontal direction and has an opening area greater than the opening area of the outer end opening within an opening range of the outer end opening in a maximum width direction in which the outer end opening has a maximum opening width as viewed from the particular horizontal direction.

2. The throttle apparatus according to claim 1, wherein the opening width of the open port in a direction orthogonal to the maximum width direction as viewed from the particular horizontal direction is greater than the opening width of the outer end opening in the particular horizontal direction within a predetermined range which includes the opening range and is greater than the opening range in the maximum width direction.

3. The throttle apparatus according to claim 1, wherein the open port is set to a size wherein the adhering water flowing down along the lower outer face toward said covering wall is cut into pieces between said covering wall and said housing body across the open port.

4. The throttle apparatus according to claim 2, wherein the open port is set to a size wherein the adhering water flowing down along the lower outer face toward said covering wall is cut into pieces between said covering wall and said housing body across the open port.

5. The throttle apparatus according to claim 1, wherein a first ventilation path and a second ventilation path are provided separately from each other in said housing body;

said ventilation path being at least one of said first ventilation path and said second ventilation path;

said first ventilation path serves also as a water draining path for allowing water in said accommodation chamber to flow out to the external space; and said second ventilation path is positioned vertically upwardly with respect to said first ventilation path and has a minimum path area smaller than the minimum path area of said first ventilation path.

6. The throttle apparatus according to claim 2, wherein a first ventilation path and a second ventilation path are provided separately from each other in said housing body;

said ventilation path being at least one of said first ventilation path and said second ventilation path;

said first ventilation path serves also as a water draining path for allowing water in said accommodation chamber to flow out to the external space; and said second ventilation path is positioned vertically upwardly with respect to said first ventilation path and has a minimum path area smaller than the minimum path area of said first ventilation path.

7. The throttle apparatus according to claim 3, wherein a first ventilation path and a second ventilation path are provided separately from each other in said housing body;

said ventilation path being at least one of said first ventilation path and said second ventilation path;

said first ventilation path serves also as a water draining path for allowing water in said accommodation chamber to flow out to the external space; and said second ventilation path is positioned vertically upwardly with respect to said first ventilation path and has a minimum path area smaller than the minimum path area of said first ventilation path.

8. The throttle apparatus according to claim 1, wherein said ventilation path is a first ventilation path and a second ventilation path provided separately from each other, and that said first ventilation path serves also as a water draining path for allowing water in said accommodation chamber to flow out to the external space.

9. The throttle apparatus according to claim 2, wherein said ventilation path is a first ventilation path and a second ventilation path provided separately from each other, and that said first ventilation path serves also as a water draining path for allowing water in said accommodation chamber to flow out to the external space.

10. The throttle apparatus according to claim 3, wherein said ventilation path is a first ventilation path and a second ventilation path provided separately from each other, and that said first ventilation path serves also as a water draining path for allowing water in said accommodation chamber to flow out to the external space.

11. The throttle apparatus according to claim 5, wherein said covering wall is a first covering wall and a second covering wall;

said covering space is a first covering space which is defined by said first covering wall and to which said first ventilation path is open and a second covering space which is defined by said second covering wall and to which said second ventilation path is open;

said housing body has a first projection positioned on the upstream with respect to said first covering space in regard to the flow of the adhering water which flows down along the lower outer face and a second projection positioned on the upstream with respect to said first projection and said second covering space; and said first projection projects vertically downwardly farther than the outer end opening of said first ventilation path and said second projection projects vertically downwardly farther than the outer end opening of said second ventilation path.

12. The throttle apparatus according to claim 8, wherein said covering wall is a first covering wall and a second covering wall;

said covering space is a first covering space which is defined by said first covering wall and to which said first ventilation path is open and a second covering space which is defined by said second covering wall and to which said second ventilation path is open;

said housing body has a first projection positioned on the upstream with respect to said first covering space in regard to the flow of the adhering water which flows down along the lower outer face and a second projection positioned on the upstream with respect to said first projection and said second covering space; and said first projection projects vertically downwardly farther than the outer end opening of said first ventilation path and said second projection projects vertically downwardly farther than the outer end opening of said second ventilation path.

13. The throttle apparatus according to claim 1, wherein a recessed space which is open to the covering space is provided in said covering wall.

14. The throttle apparatus according to claim 2, wherein a recessed space which is open to the covering space is provided in said covering wall.

15. The throttle apparatus according to claim 3, wherein a recessed space which is open to the covering space is provided in said covering wall.

16. A throttle apparatus comprising:

a throttle body for supporting a throttle valve for controlling the flow rate of air to flow through an air path;

a driving apparatus having an actuator for driving said throttle valve;

a transmission mechanism for transmitting a driving force of said actuator to said throttle valve;

a housing including a ventilation path for communicating an accommodation chamber in which said transmission mechanism is accommodated and an external space, said housing including a housing body with a body outer face having an outer face portion to which water in the external space can adhere and in which said ventilation path is provided and a covering wall for cooperating with said housing body to define a covering space having an open port opened to the external space;

an outer end opening of said ventilation path opened to the covering space at a lower outer face of the body outer face which faces vertically downwardly; and a covering region, wherein said covering wall covers the covering region, said covering region including the entire outer end opening and a peripheral face of the lower outer face around the outer end opening, from vertically downwardly and connects to said housing body on the upstream side with respect to the outer end opening in the covering region in regard to a flow of the adhering water which flows down along the lower outer face;

wherein the open port is opened toward a particular horizontal direction and has an opening area greater than the opening area of the outer end opening within an opening range of the outer end opening in a maximum width direction in which the outer end opening has a maximum opening width as viewed from the particular horizontal direction.

17. The throttle apparatus according to claim 16, wherein the opening width of the open port in a direction orthogonal to the maximum width direction as viewed from the particular horizontal direction is greater than the opening width of the outer end opening in the particular horizontal direction within a predetermined range which includes the opening range and is greater than the opening range in the maximum width direction.

18. The throttle apparatus according to claim 16, wherein the open port is set to a size wherein the adhering water flowing down along the lower outer face toward said covering wall is cut into pieces between said covering wall and said housing body across the open port.

19. The throttle apparatus according to claim 17, wherein the open port is set to a size wherein the adhering water flowing down along the lower outer face toward said covering wall is cut into pieces between said covering wall and said housing body across the open port.

20. The throttle apparatus according to claim 16, wherein a first ventilation path and a second ventilation path are provided separately from each other in said housing body;

said ventilation path being at least one of said first ventilation path and said second ventilation path;

said first ventilation path serves also as a water draining path for allowing water in said accommodation chamber to flow out to the external space; and said second ventilation path is positioned vertically upwardly with respect to said first ventilation path and has a minimum path area smaller than the minimum path area of said first ventilation path.

* * * * *